United States Patent [19]

Schäfer-Burkhard

[11] 4,311,618

[45] Jan. 19, 1982

[54] CLEANSER WITH IONIC AND NONIONIC SURFACTANTS

[76] Inventor: Werner Schäfer-Burkhard, Auf der Wacht 33, CH-4104 Oberwil-Bl, Switzerland

[21] Appl. No.: 175,595

[22] Filed: Aug. 5, 1980

Related U.S. Application Data

[63] Continuation-in-part of Ser. No. 887,904, Mar. 17, 1978, abandoned.

[30] Foreign Application Priority Data

Mar. 18, 1977 [CH] Switzerland ..... 3471/77

[51] Int. Cl.[3] ..... C11D 1/83; C11D 1/835; C11D 3/30; C11D 3/43

[52] U.S. Cl. ..... 252/542; 252/153; 252/171; 252/544; 252/545; 252/546; 252/547; 252/548; 252/549; 252/DIG. 10; 252/106

[58] Field of Search ..... 252/153, 544, 547, 548, 252/106, 542, 171, 545, 546, 549

[56] References Cited

U.S. PATENT DOCUMENTS

| | | | |
|---|---|---|---|
| 3,346,504 | 10/1967 | Herrman | 252/545 |
| 3,346,873 | 10/1967 | Herrmann | 252/545 |
| 3,935,130 | 1/1976 | Hirano et al. | 252/542 |
| 3,969,281 | 7/1976 | Sharp | 252/542 |
| 4,087,387 | 5/1978 | Willems et al. | 252/546 X |
| 4,158,644 | 6/1979 | Hammerel | 252/546 X |
| 4,174,304 | 11/1979 | Flanagan | 252/546 X |
| 4,203,872 | 5/1980 | Flanagan | 252/546 X |

*Primary Examiner*—Dennis L. Albrecht

*Attorney, Agent, or Firm*—Neuman, Williams, Anderson & Olson

[57] ABSTRACT

Cleanser composition containing at least one surfactant, at least one nonionic surfactant with HLB value of 5–20, at least one amphoterically dissociating agent capable of breaking bridge bonds in cross-linked proteins, and at least one water-miscible or water-soluble aprotic lipophilic solvent.

37 Claims, No Drawings

CLEANSER WITH IONIC AND NONIONIC SURFACTANTS

CROSS REFERENCE TO RELATED APPLICATIONS

This application is a continuation-in-part of application Ser. No. 887,904, filed Mar. 17, 1978, now abandoned.

BACKGROUND OF THE INVENTION

The present invention relates to a cleanser concentrate containing ionic and nonionic surfactants, also known as "tensides."

The removal of residues of biological materials such as those blood serums, cell cultures and bacteria media (e.g., agar) creates special difficulties when one deals with dirty surfaces of glasses, plastic vessels, hose systems, and linings of containers and equipment for laboratory diagnosis analysis.

The increasing automation of laboratory diagnosis procedures makes the cleansing process, which becomes necessary after every determination, an essential component in the reliable functioning of analysis systems. Hence, one must establish particularly high requirements for the reliable operation of special cleansers.

One of the most difficult cleansing problems is that presented by dried-on, biological material, comprised of cross-linked, often partially denatured proteins with poor solubility in water. In the thermal or oxidative cross-linking of proteins, free mercapto groups are transformed into disulfide bridges while, at the same time, the intramolecular structure-determining bridge bonds, (i.e., those bonds between the amphoterically reacting free carbonic acid groups, those bonds between carbonic acid groups and the primary amino-group, and the hydrogen bridge bonds) are destroyed. These functional groups then form other intermolecular or intramolecular bonds. This ionic cross-linking is accompanied by stereo-chemical configuration changes whereby the hydrophobic molecule segments of the proteins accumulate in a micellar fashion. The result of these processes is cross-linked proteins which are not soluble in water.

The conversion of the residues of such biological materials into partly or totally soluble residues can be attained only by using reagents that reverse the above-described chemical and physical cross-linking processes.

Prior to this invention, it had been necessary to use relatively aggressive media to reverse the cross-linking process. Contaminated containers and equipment would be placed for a long time in heavily acidic oxidizing media, such as, chromosulfuric acid. Alternately, alkaline media which caused hydrolysis of the biological components, especially by saponification of fats and alkaline splitting of the proteins and phosphatids, could be used.

However, these aggressive media can only be used on surfaces which can themselves resist extreme pH's and oxidizing conditions. For less resistive surfaces, it is necessary to use enzymatic cleansers wherein the decomposition or reduction of the biological material is accomplished by proteases and lipases. The primary disadvantages of enzymatic cleansers are that they are slow-acting and that their action may be halted by the presence of certain surface-active substances with enzyme-blocking effect.

Increasingly sophisticated laboratory diagnosis procedures and equipment place definite limitations on the use of cleansing methods of the kind hereinabove described. These limitations are a function primarily of the chemical resistance of the materials used in sophisticated equipment. Complex apparatus normally cannot be treated safely with chromosulfuric acid.

Detailed investigations show that use of strongly alkaline cleansing solutions results in considerable retention and chemical adsorption of alkali metal ions on glass and plastic surfaces. These ions cannot be removed by clean rinsing or washing. Their presence seriously interferes with quantitative analytical determination of $Na^+$, $K^+$ and $Ca^+$ ions, which frequently takes place into the micro- and even nanogram range. The determinations of phosphate can also be affected by the presence of such ions.

In addition, it has been shown that surfactants can be bound adsorptively and resorptively on plastic surfaces. The presence of bound surfactants may seriously affect the determination of alkali and alkaline-earth ions and may hinder enzymatic procedures as well.

The adsorption and chemical sorption of cleansing agent residues on the surfaces of treated materials is a phenomenon more serious than commonly assumed. (G. A. Somorjai, "Chemical Bonds on Surfaces", Angewandte Chemie [Applied Chemistry], 89, 1977, pages 94–102). In order to prevent uncertainty and considerable fluctuations in the measured values due to adsorbed residues, it is necessary to use novel concepts in fabricating special cleansers for laboratory diagnosis instruments and other aids.

Accordingly, a major object of this invention is to provide a new special cleanser which does not require the aggressive agents required heretofore. Another object of this invention is to provide a new special cleanser which does not require the presence of sodium, potassium, calcium and phosphate ions or enzymes. A third object of the present invention is to provide a cleanser that minimizes adsorption on solid surfaces, whereby properly administered rinsing or washing processes using deionized water will give cleansed materials which exert only an insignificant or unmeasurable influence on subsequent laboratory diagnosis determinations.

According to theoretical concepts, these objects can be achieved by the following precepts:

(a) One can break, cancel or neutralize the intermolecular and intramolecular bridge bonds formed during the cross-linking of proteins. Such bonds can be described with the aid of the following formula diagram:

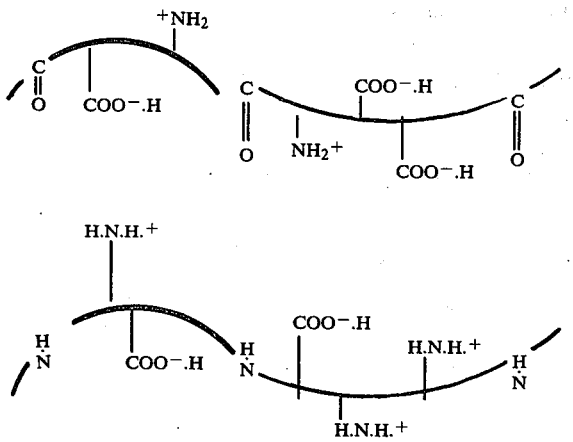

Breaking these bonds may be accomplished by using a cleanser containing an amphoterically dissociating agent which is believed to react through the resalting process with at least one of the functional groups participating in the bridge bond or formation. This can be done when, for example, the hydrochloride or sulfate of a weaker dissociating organic base is resalted with the free amino groups of the proteins. Alternately, the salt of a stronger organic base and a weak acid may act upon the free carbonic acid groups of the proteins.

In both cases, resolubilization is most favored if the remaining weaker dissociating ion partner of the amphoterically dissociating component of the cleanser is so hydrophilic that the remaining bridge binding ion of the protein is likewise hydrophilized due to salt formulation. Such a process would take place according to the following scheme:

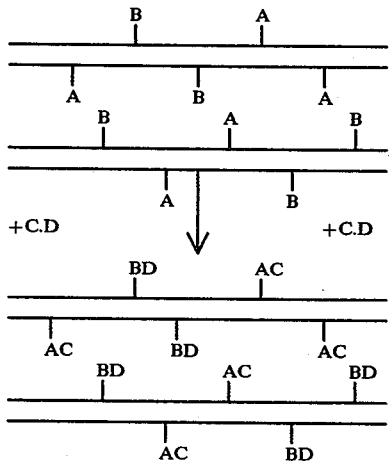

Legend:
A - Carbonic acid group;
B - Primary amino group;
C - Weak organic cation;
D - Heavily dissociating anion.

(b) The hydrophobic molecule parts of the biological material, which are accumulated in a micellar manner, must likewise be hydrophilized. This can be achieved by means of certain surfactants, or by means of certain organic solvents. For this function, one can use chemical-physical action principles such as described by W. Schafer, "Pre-treatment of Metallic Surfaces with Chemical Agents," [Mitteilungen des Verins deutscher Emailfachleute e.V. [Bulletin of the Association of German Enamel Experts, Inc.], Volume 9, 1961, pages 25–34.

(c) In view of the specific use of the cleansers, they must be fabricated in such a fashion that they are essentially free of sodium, potassium, calcium and phosphate ions. This requires special pretreatment for the surfactants which are to be used in the cleansers. This problem is solved by the present invention.

SUMMARY OF THE INVENTION

The present invention is concerned with a cleanser concentrate containing the following components:

(a) 3–20% by weight of one or more ionic surfactants;

(b) 5–30% by weight of one or more nonionic tensides with HLB values of 5 to 20 [HLB Value = the relation between the contribution of the polar hydrophilic head and the nonpolar lipophilic tail. See Schick, Nonionic Surfactants, pp. 607–613 (1967)];

(c) 5–40% by weight of one or more salts of weak organic bases and strongly inorganic or organic acids and/or one or more salts of strong organic bases and weak acids, said salts also termed herein as "amphoterically dissociating agents."

(d) 5–50% by weight of one or more aprotic solvent compounds further characterized as materials which in the presence of components (a) to (c) and (e) to (i) are water-miscible or water-soluble aprotic lipophilic solvents. These can include, but are not limited to:

(1) ethers with N,N-dialkylaminoalkyl groups; and/or (2) esters with N,N-dialkylaminoalkyl groups; and/or (3) aliphatic, cycloaliphatic, and/or aromatic compounds with tertiary nitrogen.

The cleanser can also optionally contain the following additional materials:

(e) 5–40% by weight of one or more polyalcohols and/or etheralcohols with a molecular weight of up to 600;

(f) 0–5% by weight of one or more biocides;

(g) 0–10% by weight of one or more metal complex forming agents in the form of carbonic-acid, sulfonic-acid, hydroxycarbonic acid, amino-carbonic-acid and/or polyaminocarbonic-acid and/or salts thereof with organic bases;

(h) 0–2% by weight of one or more inhibitors against acid metal corrosion;

(i) 0–5% by weight of one or more peroxide compounds;

(j) 0–75% by weight of water.

DESCRIPTION OF PREFERRED EMBODIMENTS

1. IONIC SURFACTANT COMPONENT(S)

The cleanser concentrate according to the present invention contains 3–20% by weight of at least one ionic surfactant. As used herein, "ionic" means "cationic" or "anionic." It is to be understood that, mixtures including only cationic surfactants together with anionic surfactants are not contemplated.

The anionic surfactants used in this invention do not contain any cations of the alkali, alkaline-earth group and no metal atoms and no phosphate groups. They generally have the formula: R-B−C+.

"B" is a hydrophilic constituent containing one or more sulfonic-acid, carbonic-acid, and sulfo-acid-ester groups. R is a hydrophobic molecule constituent. As used herein, a "hydrophobic" group can consist of a linear or branched hydrocarbon chain with at least six carbon atoms, an alkyl or polyalkyl substituted aromatic group, or an alkyl substituted heterocyclic compound. The alkyl or polyalkyl substituted aromatic groups and the alkyl-substituted heterocyclic groups may contain other functional groups such as carbonamide, sulfonamide, carbonic-acid, or sulfonic-acid, ester, amino-, imino-, and thioether. Also suitable as anionic surfactants are compounds where, between the hydrophobic hydrocarbon moiety R and the anionically dissociating acid group B there are moieties which improve water solubility such as, for example, carbohydrates and polyhydroxyalkylene-polyalkoxyether groups.

Substituent "C" of the anionic surfactant may consist of ammonium and hydrazonium ions of partially or fully substituted aromatic and heterocyclic amines, polyamines, imines, and polyimines. The aliphatic and aromatic portions of these compounds may be further substituted with hydroxyl and ether groups such as, mono- or polyalkylolamines or imines.

Instead of anionic surfactants, cationic surfactants can be used according to the present invention. Usually the cationic surfactants of this invention have, at a high level of generality, the formula:

$$P_mK_n{}^+Q_n{}^-$$

where P is a hydrophobic group as defined above, K is a basic group formed of one amino group or a polyamino compound that may be substituted in place of hydrogen by aliphatic, polyoxalkyl, aromatic, alkyl aromatic, or heterocyclic moieties, which moieties may be linked to form heterocyclic rings.

Q represents a group which makes the cationic molecule part soluble in water through the quaternization of the nitrogen atom or atoms. This quaternization can take place due to ammonium salt formation between the cationic base and an organic and/or inorganic acid, or due to quaternization with halogenated hydrocarbons or other organic compounds carrying a negative substituent, such as alkyl-nitrates, alkylphosphates, alkylsulfates, or other like compounds.

Hence, in one form where the cationic surfactant is based on a series of polyalkylene polyamines, the cationic surfactants may take the more specific formula:

$$PR_1R_2N^+K.Q^-$$

Wherein P is a hydrophobic group as defined above, Q is defined as above, $R_1$ and $R_2$ may be hydrophobic groups, H, aliphatic, aromatic, alkyl aromatic, heterocyclic or polyoxyalkyl; K may be the same as $R_1$ and $R_2$, except that it may not be a hydrophobic group, or K may be a quaternized polyalkylene polyamino group with the formula:

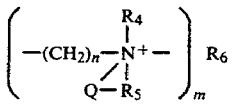

where:

n=1-3;

m=1-6; and $R_4$, $R_5$, and $R_6$ have the same definition as $R_1$ and $R_2$.

Although, as mentioned, $R_1$, $R_2$, $R_3$, $R_4$, $R_5$, and $R_6$ may be hydrophobic groups, compounds with a total of more than three hydrophobic groups are not contemplated by the invention.

Cationic surfactants having the following general formula are particularly efficacious:

$$R_1R_2R_3R_4N^+.OH^-$$

wherein $R_1$, $R_2$, and $R_3$ are lower alkyl-, simple aryl- and/or simple aralkyl groups and where $R_4$ is a long ($C_6$–$C_{22}$) chain hydrocarbon. In these compounds, the quaternary ammonium group thus does not contain any halogen atoms but rather the $-N^+.OH^-$ group. These hydroxylated quaternary salts have particularly good solution properties for biological material, especially on membranes and proteins.

2. NONIONIC SURFACTANT COMPONENT(S)

The nonionic surfactant employed in the present invention has an HLB value of 5–20 and can be a mixture. It can contain chemical groups, such as, carbonamide, sulfonamide, carbonic-acid-ester groups or elements such as nitrogen and sulfur in a nonreactive form.

The nonionic surfactants are substances, the molecules of which have hydrophobic and hydrophilic moieties. The hydrophobic molecule moiety is the same as described above, but the hydrophilic portion consists only of nonionic substituents, such as, for example, polyoxyethylene and/or polyoxypropylene groups, or polyhydroxy alkylene groups of carbohydrate type.

This nonionic hydrophilic group can be connected with the hydrophobic molecule party by an ether linkage or by carbonic acid ester or sulfonic acid ester groups.

It is preferred to use nonionic compounds where the hydrophilizing polyalcohol or polyether moieties are at both ends of the hydrophobic molecule part. Examples of such compounds are propylene oxideethylene oxide block polymerisates or the alkoxylation products of alkylene diols or alkylene diamines with central hydrocarbon portions of 2 to 20 carbon atoms. Alkylation products of dialkyl amines and/or diarylamines or alkylaryl amines, where overall, at least six carbon atoms are present in the hydrocarbon portion as substituents, also have favorable properties for the production of the cleanser according to the invention. Furthermore, compounds based on a polyether are suitable, such as those obtained through the conversion of epoxides with alkyl or alkylaryl alcohols, thiols, amines, and/or their polyalkoxy or polyhydroxy ethers, such as, for example, the compounds glyceryl-1- (fatty alkyl $C_{8-10}$-hexaethyleneoxide-)-3-butylether and sorbitylbis-(2'-ethylhexyloxy-1,3-glyceryl)-ether.

Compounds containing the above-described nonionic surfactants demonstrate very strong solution-starting effects on hydrophobic substances, because the hydrophobic portions of the surface-active compounds are distributed over the two molecule ends. Especially preferred are combinations incorporating the above-mentioned nonionic block polymerisates, of propylene oxide and ethylene oxide, where the hydrophilic group is at both ends of the molecule.

One essential feature of the invention is that the initial materials needed for its composition must be deionized prior to their processing, to the extent that they do not contain undesirable ions from their synthesis, especially those of the alkali- and alkaline-earth group as contamination. This applies above all to the above-mentioned nonionic surface-active substances which, for the purpose of avoiding adhesions to the boundary surfaces intended for cleansing, frequently provide the major portion of the surfactants to be used.

For example, a common method for forming polyethers is base-catalyzed alkoxylation, wherein caustic alkalis, as well as alkalialcoholates and lithium hydroxide are employed. These ions of the alkaline and alkaline-earth group, coming from the catalysts, must be removed from the corresponding initial or starting materials prior to processing into final product of the present invention.

Hence, according to the invention, the nonionic compounds, which contain low levels of catalyst-derived alkaline ions, are diluted with water or with mixtures of water and alcohols to form 20–50% solutions. Subsequent treatment with certain ion exchange substances, preferably ion exchange resins preferably containing polymeric anionic groups, removes the contaminating ions. Depending upon the viscosity of the aqueous solutions obtained, the nonionic compounds are allowed to run through an ion exchange column. Alternately, the aqueous solutions may be treated by suspending ion exchange resins with small particle size and large surfaces in the solutions to form a paste. Subsequent filtration yields a deionized solution of the nonionic surfactant.

3. AMPHOTERICALLY DISSOCIATING AGENT(S)

The compositions of the present invention also contain 5–40% by weight of amphoterically dissociating ion forming agents which react with the functional groups of proteins through a resalting process accompanied by conformation and structural alterations.

The preferred amphoterically dissociating ion forming agents are salts of organic amino and imino compounds as well as salts of the carbamide series, such as carbamide hydrochlorides and sulfates, iminocarbamide hydrochlorides, sulfates and citrates, dicyandiamidine salts, dicyandiamide salts, the salts of biguanidine, and the like.

Other preferred salts are hydrochlorides, sulfates, and salts of organic acids, such as citrates and lactates, of polyhydroxyalkylene diamines and polyalkylene polyamines. Also preferred are strongly amphoterically dissociating compounds which are obtained through partial hydroxyalkylation of polyamino polyalkylene and polycarbonic acid derivatives. An example of such a compound is the conversion or reaction products of diethylenetriamine with 2 moles of chloroacetic acid with 3 moles of ethylene or propylene oxide. These compounds correspond to the general formula:

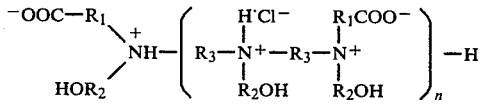

Wherein $R_1$, $R_2$ and $R_3$ are straight or branched chain hydrocarbons between 1 and 6 carbons, and n is greater than or equal to one. Alternately, they may be buffered to a neutral or slightly basic pH with weaker ammonium compounds having the general formula:

$$R_1R_2R_3N^+H.X^-$$

wherein $R_1$, $R_2$ and $R_3$ are hydroxylated lower alkyl groups, and X is an anion selected from the group consisting of halides, sulfate, and organic acid anions.

A preferred class of amphoterically dissociating ion forming agents with surface-active characteristics are those wherein longer fatty alkyls are connected with the polybasic compounds either via carbonamide bridges or via ether groups. In this type of compound, longer fatty alkyl groups, especially with $C_{18}$–$C_{26}$ are preferred, because in combination with foam-attenuating additives they demonstrate only little foam development. Products of this kind are obtained, for example, when one reacts epoxy group-carrying fatty alkyl derivatives with the polyamino compounds and thereupon makes the corresponding amphoterically dissociating salts with hydrochloric acid, sulfuric acid, or organic acids.

Compounds of this kind have the following formula:

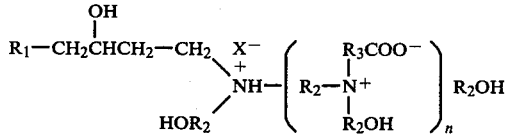

wherein $R_1$ is a straight or branched chain hydrocarbon with between 16 and 26 carbon atoms; wherein $R_2$ and $R_3$ are lower alkylene groups with between 1 and 6 carbon atoms, wherein X is an ion selected from the group consisting of chloride, sulfate, and anions of organic acids, and wherein n is from 0 to 5.

4. ORGANIC APROTIC SOLVENT(S)

The composition also contains 5–50% by weight of an organic solvent. The preferred organic solvents are those with aprotic character and sufficient water solubility as well as a strong defatting effect and a swelling effect on hydrophobic portions of biological material. These are primarily nonaqueous solvents which do not contain any ionizable proton in the molecule.

According to the present invention, the preferred solvents have hydrophilic character. They are water-soluble either alone or in combination with the above-mentioned surfactants. They include, for example, bisalkylethers of ethylene glycols, the oxyethylated polypropylene glycols, preferably with a molecular weight below 300, dioxane and dioxolane.

Also included are dialkyl acid amides, such as, for example, N,N-dimethylformamide and the N,N-dialkylacetamides, as well as other compounds, such as, dimethylsulfone, dimethylsulfoxide, hexamethyl-phosphoric acid triamide, and the diesters or alkoxy-esters of the polyalkylene glycols, such as, for example, methyldiglycol acetate, methylglycol acetate, and tetraethylene glycol diacetate.

In addition to the above-mentioned aprotic solvents, the ethers or esters of dialkylalkyleneamines and imines, for example, methoxy- or ethoxyglycol-N,N-dialkylamino ethyl ether can be employed. Organic aliphatic and cyclic amino compounds, where the amino nitrogen is present in a tertiary bond, can likewise be used advantageously, both by themselves, and in mixtures with the above-mentioned solvent types.

Compounds of this type with strong solvent character, for example, include 1-methylimidazole, 1,2-dimethylimidazole, bis-(β;N,N-dimethylamino ethyl) ether, N-β-methoxy ethylmorpholine, N-alkyl derivatives of pyrrolidone, and the like.

The above-mentioned solvents can be used in the compositions both by themselves and as mixtures with each other.

5. OPTIONAL INGREDIENT(S)

The composition of the present invention can, if desired, include 5–40% by weight of certain solution aids, when the above-mentioned organic solvents used demonstrate only limited water solubility and, during the dilution of the substances in water, tend toward the formation of emulsions. The solution aids must be coordinated with the surfactants for maximum solubility.

It is preferred to use solution aids which demonstrate both excellent water solubility and good solubility in water-insoluble solvents. Suitable examples include polypropylene glycols with molar weights of up to 600, 1,6-hexanediol, isomeric butane- and pentanediols, as well as oxyethylated or polyoxyethylated alkanols, such as, hexanol mono-glycol ether, octanol mono-to-penta glycol ethers, as well as monalkyl ethers of glycerin.

Particularly useful are solution aids with foam-attenuating or foam-preventing effects on the overall combination so that the claimed substance mixtures can also be used in automatic cleaning machines.

The compositions can also include up to 5% by weight of biocidally acting substance mixture, which, during the use of the special cleanser according to the invention, kills the microbiological systems, such as bacteria, viruses, fungi, and the like, that have remained or grown on the surfaces of glassware or equipment to be cleansed.

It is preferred to use biocides which, in coordination with the remaining components of a special cleanser, develop their microbiocidal effect only in the prescribed application concentrations but which, upon stronger dilution with water, lose their microbiocidal effect as completely as possible. This characteristic, known as the "microbiocidal tandem effect" makes it possible to assure complete microbiocidal effects only within certain concentration ranges of the cleanser application solutions, whereas there is no such effect when the cleanser solution is more heavily diluted. This microbiocidal stage or phase effect is desired in order to prevent any negative impairment of the microbiological systems found in public waters, sewers, and treatment plants.

The microbiocidally active substances must be chosen such that their microbiocidal effect will not be lost due to chemical reaction with the remaining cleanser components or constituents. This applies especially when quaternary ammonium biocides are used which, upon simultaneous use of anionically dissociating surfactants, can enter into complex compounds with the former and thereby lose their microbiocidal effect.

Suitable examples of biocides include trichloroacetamide, trichloroacetyl-N-(β-chlorethyloxyethyl) amide, alkyl phenols with one or more alkyl substituents with at least 3–10 carbom atoms, anionically dissociating surface-active bactericides, such as fatacylated benzoacrylic acids and S-alkylthissuccinic acids and their salts, amphoteric tension-active substances with betaine structure such as compounds of the type N-fatty alkyl-dimethyl-β-carboxyethyl or methyl ammonium halogenides, and derivatives of the fat-alkylated imidazolin carboxylates.

Suitable nonionic bactericidal compounds include aliphatic phenolalkyoxy and polyhydroxy ethers, such as, for example, guaiacol, phenoxy ethanol and isopropanol as well as phenol glycerine ether, and alkylphenol glycerine ethers and their corresponding glycerin-chlorohydrin ethers.

The formates and sorbates or organic bases which may function as amphoterically dissociating salt forming agents may also provide the necessary microbiocidal effect up to certain degrees of dilution.

The substances mentioned as examples can be used not only by themselves but also as mixtures of each other in the products. However, one must always make sure that any possible anionically dissociating tension-active constituents, as components of the special cleansers, will not react with the microbiocidally acting components in such a way which could restrict or cancel out their effectiveness.

The compositions can also contain up to 10% by weight of organic base salts of metal ion sequestrating carbonic acids or polyamino carbonic acids. This material has the purpose of sequestrating any alkali, alkaline-earth, and heavy metal cations which have remained inside the apparatus systems and on the glass surfaces or metal surfaces of instruments and preventing their redeposition or retention on the surfaces to be cleansed.

Compounds listed above as amphoterically dissociating agents may be suitable sequestrating agents, especially those which, within the molecule, contain basic amino or imino groups or mono- or poly-carbonic acid groups.

In addition, one can also use derivatives of nitrilotriacetic acid, of ethylene diamine tetracetic acid, of hydroxylalkyl ethylene diamine triacetic acid and the terminally carboxylated alkyl polyoxyethylethers, such as pure n-octyl-octaoxy-ethyletherglycolic acid. One can also use as sequestration agents, organic acids such as tartaric, citric, and gluconic acids and polymeric alkylene-polycarbonic acids, such as, for example, poly-1-hydroxybutane-3,4-dicarbonic acid. Similarly, the mixed polymerisates from methyl vinyl ether and maleic acid anhydride as well as similar mixed polymerisates with polymeric carbonic acid groups may be used.

As is the case for the other ingredients of the invention, the sequestration agents must not contain any alkali or alkaline-earth metal ion. To the extent that they are not themselves already water soluble, they may be made solublizable by reaction with simple or polymeric nitrogen group-containing organic bases to form corresponding water-soluble salts.

The sequestering compounds can also serve as acid components of the amphoterically dissociating compounds. Hence, they may assume a twin function in that they react with the biological materials through resalting processes as well as by sequestering cations present in the apparatus to be cleaned.

The composition of the present invention can also contain up to 2% by weight corrosion inhibitors which protect the metal surfaces to be cleansed against corrosion and acid attack in the presence of heavily acidly dissociating anions within the cleanser compositions. Substances having this function are generally known as acid inhibitors because, through intermediate adsorption or chemical sorption on metal surfaces, they screen the latter against action of the acids and block any corrosive metal removal.

Acid inhibition is performed to some extent by tension-active substances with simple or polybasic groups, in other words, by both the cationic and the amphoterically dissociating surfactants listed above. One can, in addition, use compounds such as alkyl thioureas, hexamethylene tetramine, fat-acylated heterocyclin compounds having ring nitrogen and sulfur atoms, trithions, and organic phosphonium salts such as carboxymethyl triphenyl phosphonium chloride, dialkyl aminoalkyl triphenyl phosphonium-chlorides, and the like. Other suitable corrosion inhibiting compounds include acetylene alcohols and diols, such as, for example, propynol, butynol, butynediol, and their oxyethylation derivatives.

The use of acid-inhibiting protective substances in each case depends on the types of surfactants present in the cleanser. Hence, one should not, if at all possible, use any heavily cationically dissociating inhibitors if the entire combination contains an essential portion of the anionic surfactants.

6. FORMULATION AND USE

The novel special cleansers of this invention are suitable for cleaning by manual methods, in automatic equipment, and by submersion bath methods. Hence, they should produce only minor quantities of foam when diluted for use. The use of slightly foaming tension-active substances is preferred. When solution aids are added, they should produce foam-attenuating or foam-preventing effects.

The exact composition of the cleansers of the present invention varies according to the particular nature of the types of contamination to be cleared off or removed. It is especially preferred to manipulate the ingredients in a preferred acidic or alkaline direction, so as to achieve maximum effects when the contaminants are, respectively, basic or acidic proteins. For example, in the case of biological materials which result from clinical diagnoses, which usually have acidic proteins represented to a greater extent, a basic cleansing composition usually shows a faster and more intensive effect than an acidic composition.

Special cleansers made according to the present invention are also particularly useful for cleaning surfaces that are contaminated with alkali and alkaline-earth ions; such surfaces may also be cleaned very nicely when the described cleanser solutions are used as neutralizer liquid for follow-up treatment. For example, one can clean glass or plastic vessels or other containers used in laboratory diagnosis analyses with strongly alkaline cleaning solutions in order to cope with particularly severe contamination, or to save time. The resulting adsorbed cations, which disturb the analytic process, can subsequently be removed from the surfaces by application of a concentrated solution of the composition of the present invention. This treatment may be performed either at room temperature or at temperatures up to a maximum of 65° C. The more heavily basically dissociating cations of the alkali and alkaline-earth group are exchanged through the resalting mechanism for the basic constituents of the cleanser components, whereby the cleanser constituents achieve their fully advantageous effects due to strong amphoteric action mechanisms.

When surfaces which have been neutralized and which have been given follow-up treatment in this fashion are then rinsed with deionized water, they are freed as well of the anions which interfere with analysis procedures. The cleansing intensity can be increased even further if one adds heavily oxidizing peroxide compounds to the compositions. As a result of peroxide addition, the disulfide bridges, between the cysteinhydrosulfide groups within the proteins which bridges are oxidatively cross-linked during denaturing, are oxidized into cysteinacid units. As a result, the hydrophilic nature of the protein is increased as is protein chain separation. See, e.g., A. L. Lehninger, "Biochemie" [Bio-chemistry], Chemie Publishers, 1975 edition, pages 49–132; G. D. Fasman and S. N. Timasheff, "Fine Structure of Proteins and Nucleic Acids", Marcel Deccer, Inc., New York.

The peroxide compounds must be free of alkali, alkaline-earth, or heavy metal cations. Suitable peroxides include, for example, hydrogen peroxide, hydrogen percarbamide, performic acid and peracetic acid.

Tertiary substituted di- and polybases as well as amphoterically dissociating amino and/or polyamino alkylene acids and their derivatives, betaines and imidazolin carboxylate compounds, and amino compounds with tertiary substituted alkyl-nitrogen compounds which form aminooxides act as stabilizers for the peroxide compounds in order to stop the autolysis of the percompounds in the cleanser concentrates during transportation and storage.

Further advantages and features of the present invention will become apparent from the following examples.

EXAMPLE 1

Forty percent by weight of deionized water is mixed with 7% by weight of butyl glycol. Into this solution were stirred and dissolved in succession the following nonionic surfactants: (a) 3% by weight of n-octylphenoxy-polypropoxy-polyethoxy-glycol with 20% poly-glycol portion and an HLB value of 9.5, having the following structure:

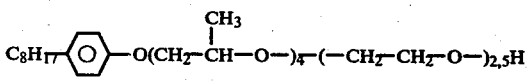

and (b) 3% by weight $C_{18-22}$ alcohol mixed polymer ethers, the polymer of which had been made from 12 moles of propylene oxide and 14 moles of ethylene oxide, having the following structure:

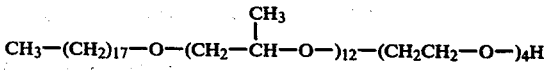

The solution of the two nonionic tensides obtained was pumped several times for demineralization through an ion exchange mixing-bed system with cation an anion exchange resins until calcium, sodium and postassium levels were unmeasurable by means of the flame test on platinum wire or by means of atomic absorption spectrometer. After this preliminary treatment, there was added into the solution in succession:

(c) 6% by weight of nonionic surfactant of the type ethylenediamine block polymers with polypropylene oxide block with a molecular weight of about 6,000 and a percentage share of 10% polyethylene oxide and, overall, an average molecular weight of about 6,600.

(d) 5% by weight N,N',N'',N'''-tetrahydroxy propyltriethylenetetramine-N,N''-di-(methylenecarboxylate)-bis-chlorhydrate, having the following structure:

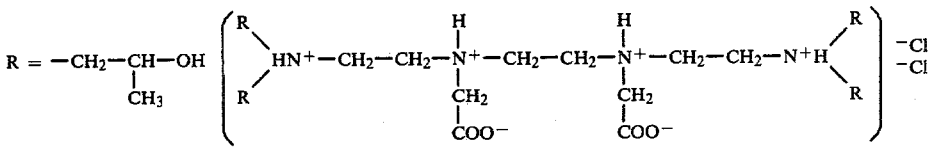

(e) 5% by weight carbamide hydrochloride, p (f) 10% by weight hexamethyl phosphoric acid triamide as aprotic solvent, industrially pure quality, (g) 6% by weight diethyleneglycol diisopropyl ether, (h) 5% by weight N,N,N',N'',N''-penta(2-hydroxyethyl)diethylenetriamine-mononitrilotriacetate salt, having the following structure:

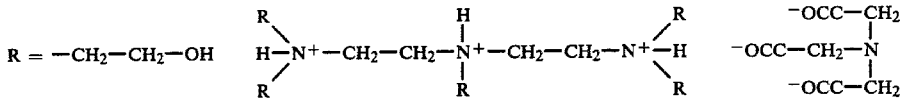

(i) 3% by weight 2(n-hexyloxy)-ethanol having the following structure:

$CH_3-(CH_2)_5-O-CH_2-CH_2-OH$ (j) 0.5% by weight ortho methoxy phenol, having the following structure:

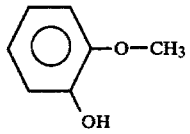

(k) 0.5% by weight 2(n-butyne-oxy)-ethanol, having the following structure:

$HC\equiv C-(CH_2)_2-O-CH_2CH_2-OH$ (l) 5% by weight of the tri-(2-hydroxypropyl) ammonium salt of n-heptanoic acid predissolved in 8% by weight of water, said salt having the following structure:

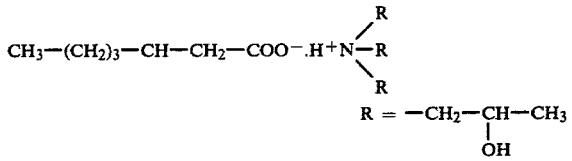

The clear and homogeneous solution obtained was then buffered with about 2% by weight of di-[2-(N,N-di(2-hydroxyethyl)aminoethyl] ether, which has the structure shown below, to a pH value of about 8.80,

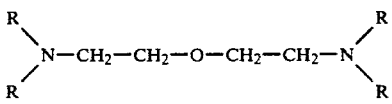

-continued $R = CH_2-CH_2-OH$ $R=CH_2-CH_2-OH$

The cleanser concentrate obtained, with a content of about 55% by weight total active material, can be used for the manual or mechanical cleansing of medical instruments for laboratory diagnosis after dilution with deionized water down to about a 5-8% by weight solution.

EXAMPLE 2

The cleaning effect of the diluted cleanser concentrate prepared in Example 1 was measured as follows: a customarily used glass vessel contaminated with uniformly dried-on blood residue was placed in a solution of the cleanser produced by Example 1, at room temperature (21° C.). After five hours, the vessel was tested for purification by comparison with untreated controls in a reflectometer. It was found to be 85% clean. After repeated washing with distilled water, the glass was spectrophotometrically tested for contamination by phosphates. No ion contamination was detected.

EXAMPLE 3

Example 2 was repeated, but the vessel was left in solution for 60 minutes at 50° C. The vessel was found to be 90% clean, without measurable ion contamination.

EXAMPLE 4

40% by weight of deionized water was mixed with 5% by weight diethylene glycol dimethyl ether. To this solution were added and dissolved in succession: (a) 4% by weight of $C_{18}$ alcohol mixed polymer ether, the polymer portion of which had been made from 12 moles of propylene oxide and 6 moles of ethylene oxide, (b) 4% by weight dekaethylene glycol-bis-(3-iso-octyloxy-2-hydroxypropyl) ether, made by means of the reaction of 1 mole of decaethylene glycol with 2 moles of isooctylglycidyl ether in the presence of 1% sodium isopropylate as catalyst, having the following structure:

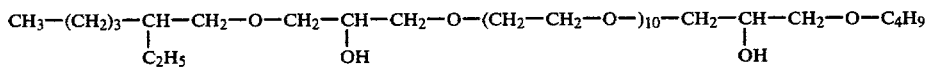

The solution of two nonionic tensides obtained in this fashion was demineralized as in Example 1.

To this demineralized solution were added in succession, with stirring, the following:

(c) 5% by weight of 2-(N-Diisooctyl) aminoethyl pentaethyleneglycol ether, having the following structure:

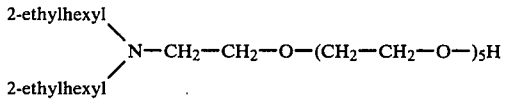

(d) 10% by weight carbamidinium sulfate, (e) 5% by weight of N,N,N',N'-tetra(2-hydroxypropyl)diethylenetriamino dihydrochloride, having the following structure:

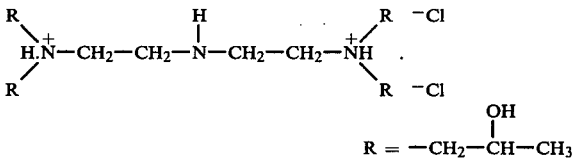

(f) 5% by weight 1,6-hexanediol, (g) 5% by weight of N-methoxyethyl pyrrolidine, (h) 5% by weight of 1,1,4,4-tetra(2-hydroxyethyl ethylenediammonium) ethylenediamine-N,N,N',N'-tetraacetate, having the following structure:

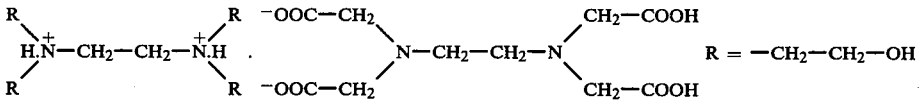

(i) 5% by weight polypropylene glycol-600,

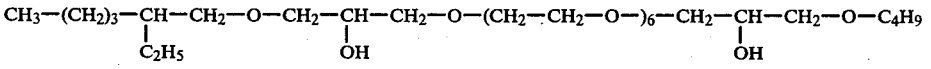

(j) 5% by weight of 2-ethylhexanol-octoethyleneglycol-sulfonic-acid-tri-isopropanol-ammonium salt, having the following structure:

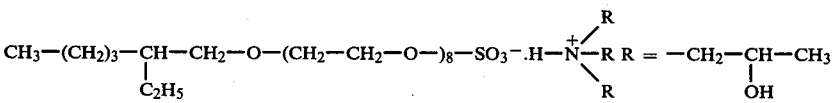

(k) 1% by weight of β-p-(2-hydroxypropoxy)-N-(2-hydroxyethyl)aniline), having the following structure:

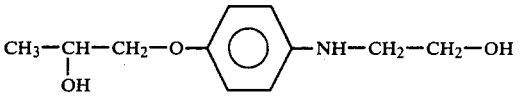

(l) 1% by weight of 1,4-butynediol.

A clear, homogeneous solution with about 58% active material was obtained. The mixture, when used as cleanser concentrate, under the application condition given in Examples 2 and 3 gave a roughly analogous effect. When used in laboratory diagnosis analysis procedures, the glass instruments, vessels, and apparatus cleansed with this product do not produce any interference in the determination of alkali and alkaline earth ions or in enzymatic testing procedures.

EXAMPLE 5

5% by weight of isopropanol are introduced into 40% by weight of deionized water and are dissolved. To this mixture are added, with stirring:

(a) 5% by weight of nonionic propyleneethylene oxide block polymerisate surfactant with a total ethylene-oxide content of about 40%, (b) 4% by weight hexaethylene glycol-(2-hydroxydecyl-(3-butoxy, 2-hydroxy propyl) ether, having the following structure:

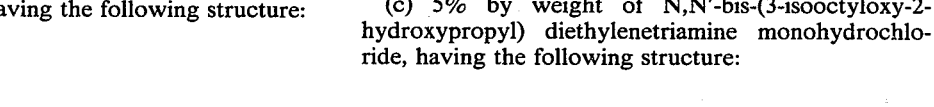

This solution of the two nonionic surfactants is then, as described in Example 1, completely demineralized by repumping via an ion exchanger column.

The following were then added to the mixture:

(c) 5% by weight of N,N'-bis-(3-isooctyloxy-2-hydroxypropyl) diethylenetriamine monohydrochloride, having the following structure:

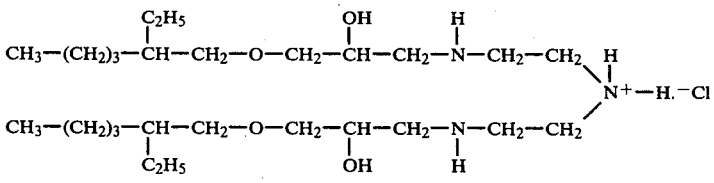

(d) 6% by weight of carbamidine hydrochloride, industrial grade, (e) 5% by weight of $C_{18-22}$alkyl, decaethoxy-methyl (β-dihydroxy-ethylamino-ethyl)-imidazolinhydrochloride, having the following structure:

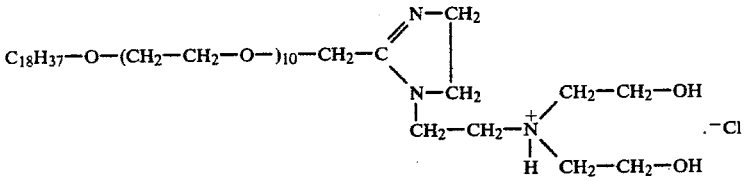

(f) 8% by weight polyethyleneimino-poly-acetdiglycolamide with the general formula:

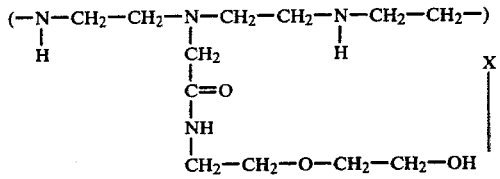

(g) 4% by weight of N-methyl pyrrolidone, (h) 4% by weight diacetone alcohol, (i) 3% by weight hexamethylphosphoric acid triamide, (j) 3% by weight tetraisobutylene, having the following structure:

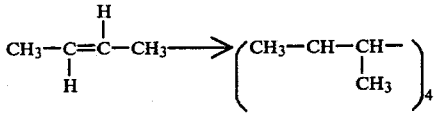

(k) 2% by weight of methylphenoxy ethanol, having the following structure:

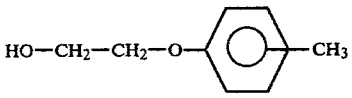

(l) 3% by weight hydrazonium caprylate, predissolved in 3% by weight of deionized water, having the following structure:

$$CH_3-(CH_2)_7-COO^-.H_3{}^+N-NH_2$$

A clear and homogeneous solution was obtained with about 43% water content. This solution was used as concentrate and is applied as special cleanser for equipment used in laboratory diagnosis as a 2–8% solution in deionized water.

The special cleanser in Example 5 was distinguished by an accelerated solution effect with respect to deionized proteins. Moreover, it demonstrated good defatting effects, as a result of which was observed a fast reaction with the protein-contained from biological contaminants.

EXAMPLE 6

Unused glass vessels for laboratory diagnosis were cleaned with a strongly alkaline commercial cleanser and left overnight in a solution corresponding to the instructions for application.

After this cleaning procedure, the vessels were rinsed with deionized water. After this rinsing process, the glass vessels had on their surface alkali ions, especially sodium ions, which exert a seriously disturbing effect on the determination of alkali and alkaline-earth ions in human blood specimens.

In order to remove these adsorptively retained residues from the glass surface, the glass vessels, which were pre-treated with the strongly alkaline cleanser, were placed into 5% solutions of the cleansers concentrates made according to Examples 4 and 5, at room temperature, overnight, and were treated with an ultrasound instrument for 20 minutes at 50° C.

After this cleansing process, the vessels were intensively rinsed with deionized water and were then dried. The glass vessels were completely free of alkali and alkaline-earth ions.

EXAMPLE 7

A special cleanser concentrate was made, as in Example 5, except that ingredient (1) was replaced with 3% by weight decyloxy-octaethyleneoxy, N-(2-N',N'-dimethylaminoethyl)acetamide, pre-dissolved in the same volume of deionized water, having the following structure:

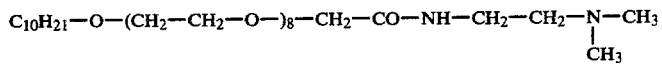

Shortly before use, 5% by weight of a 30% solution of hydrogen peroxide is added to the cleanser concentrate.

A 3–5% application solution of the concentrate has superior properties for removing dried blood specimens.

If the material to be removed from the surfaces involves biological contamination by a substance whose isoelectric point is primarily in the acid range, for example, many human proteins, then the organic bases-hydrochlorides which are listed in Examples 1–7, can also be used as free organic bases, to the extent that they are water-soluble as such, or to strengthen the hydrophilic character of the surfactants used.

What claimed is:

1. A water soluble cleanser concentrate composition comprising:

(a) at least one ionic surfactant present in the amount of about 3% to about 20% weight;

(b) at least one nonionic surfactant having an HLB value from about 5 to 20, present in the amount from about 3% to about 20% by weight;

(c) at least one amphoterically dissociating agent capable of breaking bridge bonds in cross-linked proteins, said agent being present in the amount from about 4% to about 40% by weight;

(d) at least one aprotic, organic, lipophilic solvent present in the amount from about 5% to about 50% by weight; said composition being essentially free of metal ions and phosphates.

2. A composition according to claim 1 wherein said ionic surfactant is an anionic surfactant.

3. A composition according to claim 2 wherein said anionic surfactant has the formula:

$$R\text{-}B^{-}.C^{+}$$

where in R is a hydrophobic moiety selected from the group consisting of: linear or branched chain aliphatic hydrocarbons with greater than six carbon atoms, alkyl and polyalkyl substituted aromatics, and alkyl-substituted heterocyclic moieties, B is a hydrophilic moiety containing at least one functional group selected from the group consisting of sulfonic acid and carbonic acid; and C is a cationically dissociating moiety selected from the group consisting of aliphatic, aromatic, and heterocyclic ammonium, hydrazonium, amino and imino compounds.

4. A composition according to claim 3 wherein R contains in addition, at least one functional group selected from the group consisting of carbonamide, sulfonamide, carbonic acid, sulfonic acid, ester, amine, imine, and thio ether groups.

5. A composition according to claim 3 wherein B is further substituted with a moiety selected from the group consisting of ether and hydroxy.

6. A composition according to claim 1 wherein said ionic surfactant is a cationic surfactant.

7. A composition according to claim 6 wherein said cationic surfactant has the formula:

$$PR_1R_2N^{+}K.Q^{-}$$

wherein P is a hydrophobic moiety selected from the group consisting of linear and branched alkylene groups with greater than six carbons, alkyl and polyalkyl substituted aromatics, and alkyl substituted heterocyclic moieties;

$R_1$=P, H, lower alkyl, hydroxyalkyl, aryl, or arylalkyl $R_2$=P, H, lower alkyl, hydroxyalkyl, aryl, or arylalkyl K=lower alkyl, aryl, arylalkyl, H, hydroxyalkyl or

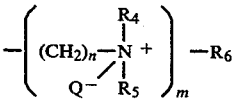

wherein n=1-3;

m=1-3;

$R_4$=P, H, lower alkyl, hydroxyalkyl, aryl or arylalkyl;

$R_5$=lower alkyl, H, aryl, or hydroxyalkyl;

$R_6$=$R_5$;

and Q is an anion selected from the group consisting of hydroxide, chloride, $PO_4$, $SO_4$, $NO_3$, alkylnitrates, alkylphosphates, and alkyl sulphates, with the proviso that the total number of hydrophobic moieties in the molecule may not exceed three.

8. A composition according to claim 7 wherein P contains in addition at least one functional group selected from the group consisting of carbonamide, sulfonamide, carbonic acid, sulfonic acid ester, amine, imine, and thio ether groups.

9. A composition according to claim 7 wherein P is a straight or branched hydrocarbon group with from 4 to 22 carbon atoms; $R_2$, $R_3$ and K are selected from the group consisting of lower alkyl, aryl, and arylalkyl, and Q is hydroxide.

10. A composition according to claim 1 wherein said nonionic surfactant has the formula:

$$C—B—R—(B—C)_n$$

wherein R is hydrophobic moiety selected from the group consisting of linear and branched chain aliphatic hydrocarbons with greater than six carbon atoms; alkyl and polyalkyl substituted aromatics, and alkyl substituted heterocyclic moieties; wherein B is selected from the group consisting of O, S, carbonamide, sulfonamide, carbonic acid ester and sulfonic acid ester, and wherein C is a hydrophilic group selected from the group consisting of polyalkoxy ethers, mannitol, sorbitol, and wherein n=1 or 0.

11. A composition according to claim 1 wherein said nonionic surfactant has the formula:

$$R—B—C—B—R$$

where R, B and C have the structure as defined in claim 10.

12. A composition according to claim 10 or claim 11 wherein said moiety R contains in addition at least one functional moiety selected from the group consisting of carbonamide, sulfonamide, carbonic acid, sulfonic acid, ester, amine, imine, and thio ether groups.

13. A composition according to claim 1 wherein said amphoterically dissociating agent is a salt of (a) a basic compound selected from the group consisting of carbonamide, imino-carbamide, dicyanic diamide, and biguanidine and (b) an acid selected from the group consisting of hydrochloric, sulfuric, citric, and lactic acids.

14. A composition according to claim 1 wherein said amphoterically dissociating agent is a salt of a polyhydroxyalkylenediamine and an acid selected from the group consisting of hydrochloric, sulfuric, citric, and lactic acids.

15. A composition according to claim 1 wherein said amphoterically dissociating agent is a salt of a polyhydroxyalkylene polyamine and an acid selected from the group consisting of hydrochloric, sulfuric, citric, and lactic acids.

16. A composition according to claim 1 wherein said amphoterically dissociating agent has the formula:

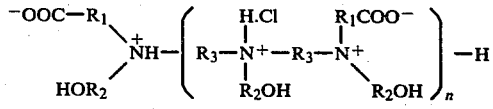

wherein $R_1$, $R_2$, and $R_3$ are straight or branched alkylene groups with between 1 and 6 carbons, and wherein n is greater than 1.

17. A composition according to claim 1 wherein said amphoterically dissociating agent is buffered to a pH of greater than 7 with an ammonium compound of the formula:

$R_1R_2R_3N^+H.X^-$ wherein $R_1$, $R_2$, and $R_3$ are hydroxylated lower alkyl groups, and X is an anion selected from the group consisting of halides, $SO_4$, and organic acid anions.

18. A composition according to claim 1 wherein the amphoterically dissociating agent is a compound of the formula:

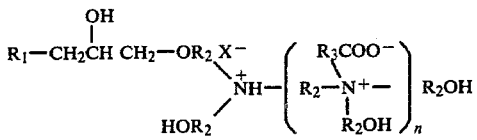

wherein $R_1$ is a straight or branched chain hydrocarbon group with between 16 and 26 carbon atoms; wherein $R_2$ and $R_3$ are lower alkylene groups with between 1 and 6 carbon atoms, wherein X is an ion selected from the group consisting of chloride, $SO_4$, and anions of organic acids, and wherein n is from 0 to 5.

19. A composition according to claim 1 wherein said aprotic lipophilic solvent has the formula:

$R_1—(O—R_2)_n—O—R_3$ wherein $R_1$ and $R_3$ are lower alkyl or acetyl; $R_2$ is alkylene with two or three carbon atoms, and n is 1–6.

20. A composition according to claim 1 wherein there is present, in addition, a minor amount of at least one solution aid.

21. A composition according to claim 20 wherein said solution aid is selected from the group consisting of polypropylene glycol with a molecular weight of less than 600, 1,6, hexanediol, butanediols, and pentanediols.

22. A composition according to claim 20 where said solution aid has the formula:

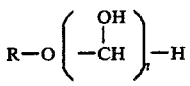

R is a hydrocarbon chain with one to ten carbon atoms and n is between one and six.

23. A composition according to claim 1 wherein there is present at least one biocide in the amount of up to about 5% by weight.

24. A composition according to claim 1 wherein there is present at least one metal cation complexing agent in the amount of up to about 10% by weight.

25. A composition according to claim 1 wherein there is present at least one acid corrosion inhibiting agent in the amount of up to about 2% by weight.

26. A composition according to claim 1 wherein: (a) said ionic surfactant is N,N,N''',N''' tetra(2-hydroxypropyl)triethylene tetramine-N',N''-di(methylene carboxylate) dihydrochloride present in the amount of about 5% by weight; (b) said nonionic surfactant comprises: (i) n-octylphenol-polypropoxypolyethoxy glycol in an amount of about 3% by weight; (ii) mixed ethers of alcohols with from 18 to 22 carbon atoms and a 3:1 copolymer of propylene oxide and ethylene oxide, present in an amount of about 3% by weight; (iii) a block polymer comprising polyethylenediamine with an average molecular weight of about 600 blocked with a 9:1 copolymer of propylene oxide and ethylene oxide with an average molecular weight of about 6000, present in the amount of about 6% by weight; (c) said amphoterically dissociating agent comprises carbamide hydrochloride present in an amount of about 5% by weight; (d) said aprotic lipophilic solvent comprises hexamethyl phosphoric acid triamide present in an amount of about 10% and diethylene glycol diisopropyl ether present in an amount of about 6%.

27. A composition according to claim 1 wherein: (a) said ionic surfactant is N,N,N''',N'''-tetra(2-hydroxypropyl) diethylenetriamine dihydrochloride present in an amount of about 5% by weight; (b) said non-ionic surfactant comprises: (i) mixed ethers of alcohols with from 18 to 22 carbon atoms and a 2:1 copolymer of propylene oxide and ethylene oxide present in an amount of about 4% by weight; (ii) decaethylene glycol bis (3-isooctyloxy-2-hydroxypropyl) ether present in an amount of about 5% by weight; (iii) 2-(N-diisooctyl)-aminoethyl pentaethylene glycol ether present in the amount of about 5% by weight; (c) said amphoterically dissociating agent is carbamidinium sulfate present in an amount of about 10% by weight; (d) said aprotic lipophilic solvent comprises N-methoxyethyl pyrrolidine present in the amount of about 5% by weight.

28. A water soluble cleanser concentrate composition comprising:

(a) at least one ionic surfactant present in an amount of from about 3% to about 20% by weight;

(b) at least one nonionic surfactant having an HLB value of from about 5 to about 20, present in an amount of from about 3% to about 20% by weight;

(c) at least one amphoterically dissociating agent capable of breaking bridge bonds in cross-linked proteins, said agent being present in an amount of from about 4% to about 20% by weight; and, (d) present in an amount of from about 5% to about 50% by weight, at least one aprotic, organic, lipophilic solvent selected from the group consisting of:

(i) a compound having the formula

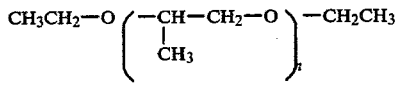

wherein n is greater than or equal to one;

(ii) a compound further selected from the group consisting of dioxane, dioxolane, dimethyl sulfone, dimethyl sulfoxide, and hexamethyl phosphoric acid triamide;

(iii) a compound having the formula:

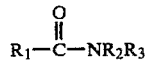

wherein $R_1$ is lower alkyl or H, and $R_2$ and $R_3$ are lower alkyl;

(iv) a compound having the formula:

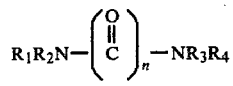

wherein $R_1$, $R_2$, $R_3$ and $R_4$ are lower alkyl and n=1 or 0;

(v) a compound having the formula:

$$R_1R_2N-R_3-O-\left(\overset{O}{\overset{\|}{C}}\right)_n-R_4$$

wherein $R_1$, $R_2$ and $R_4$ are lower alkyl, $R_3$ is lower alkylene, and n=1 or 0;

(vi) a compound having the formula:

$$R_1N=CH-R_2-\left(\overset{O}{\overset{\|}{C}}\right)_n-R_3$$

wherein $R_1$ and $R_3$ are lower alkyl, $R_2$ is lower alkylene, and n-1 or 0;

(vii) a compound having the formula:

$R_1$-$R_2$ wherein $R_1$ is lower alkyl, and $R_2$ is an aprotic heterocyclic secondary amino group bound with $R_1$ to form a tertiary amine;

(viii) a compound having the formula:

$R_1R_2N-R_3-OR_4-NR_5R_6$ wherein $R_1$, $R_2$, $R_5$ and $R_6$ are lower alkyl, and $R_3$ and $R_4$ are lower alkylene, said composition being essentially free of metal ions and phosphates.

29. A water soluble cleanser concentrate composition comprising:

(a) at least one ionic surfactant present in an amount of from about 3% to about 20% by weight;

(b) at least one nonionic surfactant having an HLB value of from about 5 to about 20, present in an amount of from about 3% to about 20% by weight;

(c) at least one amphoterically dissociating agent capable of breaking bridge bonds in cross-linked proteins, said agent being present in an amount of from about 4% to about 20% by weight; and (d) an aprotic, lipophilic solvent having the formula:

$$CH_3CH_2-O\left(-\underset{\underset{CH_3}{|}}{CH}-CH_2-O\right)_n-CH_2CH_3$$

wherein n is greater than or equal to one, said solvent being present in an amount of from about 5% to about 50% by weight; said composition being essentially free of metal ions and phosphates.

30. A water soluble cleanser concentrate composition comprising:

(a) at least one ionic surfactant present in an amount of from about 3% to about 20% by weight;

(b) at least one nonionic surfactant having an HLB value of from about 5 to about 20, present in an amount of from about 3% to about 20% by weight;

(c) at least one amphoterically dissociating agent capable of breaking bridge bonds in cross-linked proteins, said agent being present in an amount of from about 4% to about 20% by weight; and (d) an aprotic, lipophilic solvent selected from the group consisting of dioxane, dioxolane, dimethyl sulphone, dimethyl sulfoxide, and hexamethylphosphoric acid triamide, said solvent being present in an amount of from about 5% to about 50% by weight; said composition being essentially free of metal ions and phosphates.

31. A water soluble cleanser concentrate composition comprising:

(a) at least one ionic surfactant present in an amount of from about 3% to about 20% by weight;

(b) at least one nonionic surfactant having an HLB value of from about 5 to about 20, present in an amount of from about 3% to about 20% by weight;

(c) at least one amphoterically dissociating agent capable of breaking bridge bonds in cross-linked proteins, said agent being present in an amount of from about 4% to about 20% by weight; and (d) an aprotic, lipophilic solvent having the formula:

$$R_1-\overset{O}{\overset{\|}{C}}-NR_2R_3$$

wherein R, is lower alkyl or H, and $R_2$ and $R_3$ are lower alkyl, said solvent being present in an amount of from about 5% to about 50% by weight; said composition being essentially free of metal ions and phosphates.

32. A water soluble cleanser concentrate composition comprising:

(a) at least one ionic surfactant present in an amount of from about 3% to about 20% by weight;

(b) at least one nonionic surfactant having an HLB value of from about 5 to about 20, present in an amount of from about 3% to about 20% by weight;

(c) at least one amphoterically dissociating agent capable of breaking bridge bonds in cross-linked proteins, said agent being present in an amount of from about 4% to about 20% by weight; and (d) an aprotic, lipophilic solvent having the formula:

$$R_1R_2N-\left(\overset{O}{\overset{\|}{C}}\right)_n-NR_3R_4$$

wherein R, $R_2$, $R_3$ and $R_4$ are lower alkyl groups and n=1 or 0, said solvent being present in an amount of from about 5% to about 50% by weight; said composition being essentially free of metal ions and phosphates.

33.

A water soluble cleanser concentrate composition comprising:

(a) at least one ionic surfactant present in an amount of from about 3% to about 20% by weight;

(b) at least one nonionic surfactant having an HLB value of from about 5 to about 20, present in an amount of from about 3% to about 20% by weight;

(c) at least one amphoterically dissociating agent capable of breaking bridge bonds in cross-linked proteins, said agent being present in an amount of from about 4% to about 20% by weight; and (d) an aprotic, lipophilic solvent having the formula:

$$R_1R_2N-R_3-O-\left(\overset{O}{\overset{\|}{C}}\right)_n-R_4$$

wherein $R_1$, $R_2$ and $R_4$ are lower alkyl, $R_3$ is lower alkylene, and n=0 or 1, said solvent being present in an amount of from about 5% to about 50% by weight; said composition being essentially free of metal ions and phosphates.

34. A water soluble cleanser concentrate composition comprising:

(a) at least one ionic surfactant present in an amount of from about 3% to about 20% by weight;

(b) at least one nonionic surfactant having an HLB value of from about 5 to about 20, present in an amount of from about 3% to about 20% by weight;

(c) at least one amphoterically dissociating agent capable of breaking bridge bonds in cross-linked proteins, said agent being present in an amount of from about 4% to about 20% by weight; and (d) an aprotic, lipophilic solvent having the formula:

$$R_1N=CH-R_2-\left(\overset{O}{\overset{\|}{C}}\right)_n-R_3$$

wherein $R_1$ and $R_3$ are lower alkyl, $R_2$ is lower alkylene, and n=0 or 1, said solvent being present in an amount of from about 5% to about 50% by weight; said composition being essentially free of metal ions and phosphates.

35. A water soluble cleanser concentrate composition comprising:

(a) at least one ionic surfactant present in an amount of from about 3% to about 20% by weight;

(b) at least one nonionic surfactant having an HLB value of from about 5 to about 20, present in an amount of from about 3% to about 20% by weight;

(c) at least one amphoterically dissociating agent capable of breaking bridge bonds in cross-linked proteins, said agent being present in an amount of from about 4% to about 20% by weight; and (d) an aprotic, lipophilic solvent having the formula:

$$R_1-R_2$$

wherein $R_1$ is lower alkyl, and $R_2$ is an aprotic heterocyclic secondary amino group bound with $R_1$ to form a tertiary amine, said solvent being present in an amount of from about 5% to about 50% by weight; said composition being essentially free of metal ions and phosphates.

36. A composition according to claim 35 wherein the aprotic cyclic amino group is selected from the group consisting of methyl imidazolyl, 1,2-dimethyl imidazolyl, p-methoxy morpholinyl and pyrrolidonyl.

37. A water soluble cleanser concentrate composition comprising:

(a) at least one ionic surfactant present in an amount of from about 3% to about 20% by weight;

(b) at least one nonionic surfactant having an HLB value of from about 5 to about 20, percent in an amount of from about 3% to about 20% by weight;

(c) at least one amphoterically dissociating agent capable of breaking bridge bonds in cross-linked proteins, said agent being present in an amount of from about 4% to about 20% by weight; and (d) an aprotic, lipophilic solvent having the formula:

$$R_1R_2N-R_3-OR_4-NR_5R_6$$

Wherein $R_1$, $R_2$, $R_5$ and $R_6$ are lower alkyl, and $R_3$ and $R_4$ are lower alkylene, said solvent being present in an amount of from about 5% to about 50% by weight; said composition being essentially free of metal ions and phosphates.

* * * * *

UNITED STATES PATENT AND TRADEMARK OFFICE

CERTIFICATE OF CORRECTION

PATENT NO. : 4,311,618

DATED : January 19, 1982

INVENTOR(S) : Werner Schafer-Burkhard

It is certified that error appears in the above-identified patent and that said Letters Patent are hereby corrected as shown below:

[54] Title: after "SURFACTANTS" insert
-- , AN AMPHOTERICALLY DISSOCIATING AGENT AND AN APROTIC SOLVENT--

Col. 1, Line 1 (Title): after "SURFACTANTS" insert
-- , AN AMPHOTERICALLY DISSOCIATING AGENT AND AN APROTIC SOLVENT--

Col. 2, Line 17: "clean" should be --clear--

Col. 3, Line 68: delete the bracket preceding "[Mitteilungen"

Col. 6, Line 40: "oxideethylene" should be --oxide-ethylene--

Col. 9, Line 63: "carbom" should be --carbons--

Col. 9, Line 65: "S-alkylthissuccini" should be
-- S-alkylthiosuccinic--

Col. 11, Line 6: "heterocyclin" should be --heterocyclic--

Col. 14, Line 13, Example 1: delete "$R=CH_2$-CH-OH"

Col. 26, Line 27, Claim 37, subparagraph (b):
"percent" should be --present--

Signed and Sealed this

*Twenty-fourth* Day of *August 1982*

[SEAL]

*Attest:*

GERALD J. MOSSINGHOFF

*Attesting Officer*

*Commissioner of Patents and Trademarks*